US005455217A

United States Patent [19]

Chang et al.

[11] Patent Number: 5,455,217

[45] Date of Patent: Oct. 3, 1995

[54] TRANSPARENTIZABLE THERMAL INSULATING FILM FOR THERMAL TRANSFER IMAGING

[75] Inventors: Jeffrey C. Chang, North Oakes; Andrew B. Becker, Woodbury; Gari P. Krogseng, St. Paul, all of Minn.

[73] Assignee: Minnesota Mining and Manufacturing Company, St. Paul, Minn.

[21] Appl. No.: 315,196

[22] Filed: Sep. 29, 1994

Related U.S. Application Data

[63] Continuation of Ser. No. 266,322, Jun. 27, 1994, abandoned, which is a continuation of Ser. No. 38,237, Mar. 29, 1993, abandoned.

[51] Int. Cl.[6] ..... B41M 5/035; B41M 5/38

[52] U.S. Cl. ..... 503/227; 428/195; 428/207; 428/318.4; 428/319.3; 428/913; 428/914

[58] Field of Search ..... 428/195, 207, 428/318.4, 319.3, 913, 914; 503/227; 8/471

[56] References Cited

U.S. PATENT DOCUMENTS

| | | | |
|---|---|---|---|
| 4,726,989 | 2/1988 | Mrozinski | 428/315.5 |
| 4,734,396 | 3/1988 | Harrison et al. | 503/227 |
| 4,734,397 | 3/1988 | Harrison et al. | 503/227 |
| 4,778,782 | 10/1988 | Ito et al. | 503/227 |
| 4,908,345 | 3/1990 | Egashira et al. | 503/227 |
| 4,971,950 | 11/1990 | Kato et al. | 503/227 |
| 4,977,070 | 12/1990 | Winslow | 430/510 |
| 4,996,182 | 2/1991 | Matsui et al. | 503/200 |
| 5,001,106 | 3/1991 | Egashira et al. | 503/227 |
| 5,252,531 | 10/1993 | Yasuda et al. | 503/227 |
| 5,378,675 | 1/1995 | Takeyama et al. | 503/227 |

FOREIGN PATENT DOCUMENTS

| | | | |
|---|---|---|---|
| 0144247A3 | 12/1984 | European Pat. Off. | 503/227 |
| 0199368A3 | 4/1986 | European Pat. Off. | 503/227 |
| 3295685 | 12/1991 | Japan | 503/227 |
| WO88/06520 | 9/1988 | WIPO | 503/227 |

*Primary Examiner*—Bruce H. Hess

*Attorney, Agent, or Firm*—Gary L. Griswold; Walter N. Kirn; Susan Moeller Zerull

[57] ABSTRACT

A thermal dye transfer system comprises a thermal dye transfer receptor element in intimate contact with a thermal dye donor sheet, said receptor element comprising a substrate having on at least one surface thereof in contact with said dye transfer donor sheet, a dye receptive receiving layer comprising a microporous polymer layer having insufficient pigment to provide an optical density of more than 0.2. The polymer layer may be transparentizable and provides thermal insulation.

29 Claims, No Drawings

TRANSPARENTIZABLE THERMAL INSULATING FILM FOR THERMAL TRANSFER IMAGING

This is a continuation of application Ser. No. 08/266,322 filed Jun. 27, 1994, now abandoned, which is a continuation of application Ser. No. 08/038,237 filed Mar. 29, 1993, now abandoned.

FIELD OF THE INVENTION

This invention relates to thermal transfer imaging, and in particular to a novel thermal dye and thermal mass transfer receptor sheet for such printing using an opaque microporous thermal insulating film beneath a dye receiving layer to reduce unwanted heat loss and to improve the formation of dye (and pigment in binder) images with better color uniformity and densities on the dye or pigment receiving layer. The film is transparentizable and is therefore also suitable for making transparencies and transferable (e.g., laminable) with exceptionally high color image densities. The process for making this type of thermal transfer is also disclosed.

BACKGROUND OF THE INVENTION

There is a growing interest in electronic color imaging for technologies that are dry processable and environmentally friendly. Among them, direct thermal, thermal mass transfer, thermal dye transfer, and dry silver imaging are the most practical and well-received processes. In all of these processes, heat is the main driving force that generates visible images. Therefore, these imaging processes are strongly dependent on how efficient the heat is utilized for imaging without unnecessary heat losses to the surrounding areas.

In thermal dye transfer imaging, an image is formed on a receptor sheet by selectively transferring a dye to a receptor sheet from a dye donor element (sheet or ribbon) placed in intimate contact with the receptor sheet. Material (e.g., dye) is transferred from the donor element, e.g., the ribbon, upon localized heating (such as that directed by a thermal print head, which consists of small electrically heated elements [print heads]). Heat generated momentarily from these elements is transferred through the dye donor to the dye receiving layer and the base of the receptor in several milliseconds. The thermal energy is used to heat and mobilize the dye, to soften the interpolymeric cohesion, and to open up free space in the resinous binders used in the donor dye layer and dye receiving layer allowing passage and "parking room" for the traveling dye molecules. Temperature plays a critical role here; the higher the temperature, the higher the dye image density.

Thermal dye transfer systems in general have advantages over thermal mass transfer system in that the former is capable of producing high quality, continuous tone, full color images. However, the systems suffer from two major drawbacks that impair their ability to make truly photographic quality color hardcopies. One of the drawbacks is that the systems need very high transfer energies, as high as several Joules of heat per square centimeter, to produce an image with adequate color density. This drawback is particularly serious in the case of making transparencies for medical imaging and overhead visual projection where high transmission optical densities are required but are difficult to achieve. In some cases, a single pass printing may not be able to produce enough image density and multiple-pass printings, as disclosed in U.S. Pat. No. 4,833,124, may be needed. The other drawback is that the dye image quality, as measured by color uniformity and density, is very much limited by the receptor's properties.

These two problems are well known in the industry, and attempts to solve them are being made by others using different approaches. For examples, U.S. Pat. Nos. 4,734,396 and 4,734,397 teach the use of a non-porous compression layer (with a compression modulus less than 350 mega Pascal) coated on a substrate to improve image-quality. The compression layer is, for example, poly(methylmethacrylate), poly(styrene-co-acrylonitrile), or polyurethane. U.S. Pat. No. 4,912,085 discloses the use of a receptor substrate comprising a molecularly oriented film of a synthetic thermoplastic polymer and an inorganic filler (i.e., polyester with barium sulfate). U.S. Pat. No. 4,935,402 also discloses the use of a dye receptor substrate made of an extruded, biaxially stretched sheet of a mixture of white particles and a polyester resin. U.S. Pat. Nos. 4,778,782 and 4,971,950 separately disclose the use of a synthetic paper (made of polyolefin resin and inorganic pigment, i.e. $CaCO_3$),as a dye receptor substrate. The polyolefin film was biaxially oriented to create microvoids.

The present invention overcomes the drawbacks of thermal dye transfer systems by providing the receptor with a uniform, microporous thermal insulating polymeric film. The films when properly incorporated in the receptors as described in this invention effectively reduce the energy requirements for dye transfer and significantly improve the resulting image uniformity and densities. The films are opaque white but transparentizable because they contain essentially no inorganic pigments in the thermoplastic films (i.e., no significantly visible amount, having an optical density of less than 0.20 D. at a thickness of 0.05 mm). This allows the production of transparencies as well as non-transparency prints.

SUMMARY OF THE INVENTION

The present invention provides a thermal dye transfer receptor element for thermal dye or thermal mass transfer in intimate contact with a dye donor sheet, the receptor comprising a supporting substrate having on at least one surface thereof a dye receptive receiving layer comprising an opaque but transparentizable insulating polymeric film underlayer.

It has been found in this invention that the incorporation of an insulating film underlayer in a dye receptor sheet drastically improves the dye receptivity of the dye receiving layer. The resulting color images not only possess higher density but also have better image uniformity. The beneficial effects are attributed to the unique properties of the film, which has excellent and uniform thermal insulating property. The films are made of organic thermoplastic polymers involving no visibly significant amount of pigment particulates and are microporous with fairly even-sized micropores distributed uniformly throughout the structure. The porosities of these films are very high, normally higher than 15% by volume, preferably between 20 and 80% by volume. The pores are moderately uniform and small in sizes, normally smaller than 25 micrometers, preferably smaller than 5 micrometers. It is desired that the average pore size of the microporous sheets of the present invention is between 0.5 and 15 micrometers, more preferably between 0.5 and 12 micrometers, and most preferably between 0.5 and 8 micrometers. Air has very low thermal conductivity and is known as one of the best thermal insulators. The presence of large amount of air in the microporous films cuts down their overall thermal conductivity from their usual 0.2 watts/m° C. to below 0.09 watts/m° C. and makes the films an excellent thermal insulator. Because the films are organic thermoplastics and contain no visibly significant amount of pigment particles and preferably none at all, they are thermally transparentizable. The pores, either all or most of the pores, should not be filled with liquids or solids, but should be gas filled, e.g., filled with air, nitrogen, carbon dioxide, etc., to provide the insulation. For example, at least 60% or at least 75% by numbers of the pores should have no liquid or solid therein, preferably at least 80% or at least 85% of the pores have gas therein.

The films, when coated or covered properly with a dye receiving layer which has strong affinity for the dye, are particularly useful for making high quality color images on either an opaque or transparent substrate sheet. They are also useful for making retransferable images to other supports of interest, such as paper, glass or films. Depending on the intended use, the films can be used together with a dye receiving layer and a suitable substrate sheet in various combinations to make transparent or opaque hardcopies.

In one embodiment of the present invention, the film is coated directly with a dye receiving layer. The coating solution must have high enough viscosity so that the dye receiving resins can stay mostly at the surface of the film and will not fill the inner pores, thereby preserving the much desired thermal insulation property of the film. The drying temperature must be controlled to avoid melting and destroying the microporous film.

In another embodiment, the microporous film is covered, coated or laminated on its surface with a dye receiving layer. The dye receiving layer can be laminated by heat, solvent or pressure sensitive adhesive to the microporous film. Usually, the dye receiving layer is very thin, less than 10 micrometers. It is preferable that the dye receiving layer is coated on a thin film support first, and then the thin film base is laminated to the microporous insulating film. The dye receiving layer can be laminated to the microporous film permanently for the production of permanent color hardcopies. It can also be temporarily laminated to the microporous film to allow easy removal of the dye receiving layer and its thin film support (hereafter referred to as an integral dye receiving layer) from the microporous film after the imaging step. The imaged integral dye receiving layer, after separation from the microporous film, can be used alone or laminated with the image side down to other subjects of interest, such as paper, transparent or opaque films, or glass. When the imaged integral dye receiving layer is laminated image side down to a desired surface, the thin polymeric film is exposed, thereby providing a protective shield for the underlying images.

The microporous films can be used alone as a substrate or they can be laminated with other sheet materials such as paper, and other polymeric substrates to gain additional dimensional stability. The substrate sheets can be either opaque or transparent. When a transparent film is used as the substrate base for the microporous film, the whole receptor can be made transparent by transparentizing the microporous film with heat. One advantageous feature of this invention is the ability of making transparencies with exceptionally high image densities from the opaque receptors that use a transparentizable microporous insulating film to guard against heat loss.

The microporous film described in this present invention is particularly suitable for use in thermal dye transfer applications. The technology can also be used in thermal mass transfer Systems. Thermal dye transfer processes normally require high energy (several Joules of heat per square centimeter) to produce an image with adequate color density. The gain in image density from this invention allows dye transfer at lower energy level.

DETAILED DESCRIPTION OF THE INVENTION

The present invention discloses that the use of microporous insulation films and especially transparentizable microporous insulating films in a thermal transfer image receptor is particularly beneficial and desirable in thermal transfer systems, either thermal mass transfer or thermal dye transfer systems, but preferably in thermal dye transfer systems. With these microporous films, both thermal insulating and transparentizing properties are imparted to the thermal transfer image receptors . This is particularly advantageous in thermal dye transfer systems that typically require high thermal energy for making images.

The efficiency of making dye images to the receptor is dependent on how the heat from each of the resistive elements is utilized in transferring dye to the dye receiving layer. The dye receiving layer is normally composed of dyeable thermoplastic resins whose dyeability or receptivity becomes effective only after receiving sufficient heat to raise the temperature beyond their glass transition temperature. It has been found that the receptor substrate consumes most of the heat because of its relatively large mass compared to the dye receiving layer (mass ratio of at least 20:1), and it is believed that heat loss to the receptor substrate is through conduction. The use of the thermal insulating layer beneath the dye receiving layer in the present invention in fact minimizes the heat loss from the dye receiving layer to the substrate. As a result, the efficiency of transferring dyes to the dye receiving layer improves, thereby forming higher image densities on the dye receiving layer. Also, the resultant images are very even because the insulating film has uniform insulating values throughout the film. The microporous polymeric films have been used previously as membranes for microfiltrations. These films are characterized by high porosity, high tortuosity, and uniform pore size distribution. Typically, they are made from thermal extrusion of a mixture of thermoplastic resins and an organic monomeric compound. Because of mutual incompatibility of the mixture at low temperature, phase separation occurs upon cooling. The microporous polymers made according to the practice of U.S. Pat. No. 4,726,989 are preferred because of their improved tensile strength, but microporous polymers may be made by other techniques and with other polymers such as those disclosed in U.S. Patent No.4,539,526 if one is willing to accept lower tensile strength in the polymer film.

There is prior art dealing with the effect of dye receptor substrate or undercoat on dye image quality. U.S. Pat. Nos. 4,734,396 and 4,734,397 claims the use of a compression layer (with a compression modulus less than 350 mega Pascal) coated on a substrate to improve image quality. The compression layer is nonporous in nature (i.e., it has a porosity of less than 5% by volume), comprising resinous materials such as poly(methylmethacrylate), poly(styrene-co-acrylonitrile), polyurethane and polyethylene. U.S. Pat. No. 4,912,085 claims the use of a receptor substrate comprising a molecularly oriented film of a synthetic thermoplastic polymer and an inorganic filler (PET with barium sulfate). U.S. Pat. No. 4,935,402 also claims the use of a dye receptor substrate made of an extruded, biaxially stretched sheet of a mixture of white particles and a polyester resin. U.S. Pat. Nos. 4,778,782 and 4,971,950 separately claimed the use of synthetic paper (made of polyolefin resin and inorganic pigment (e.g. $CaCO_3$) as a dye receptor substrate. The synthetic paper is multilayer thermoplastic film comprising a mixture of a polyolefin resin and an inorganic pigment filler such as $CaCO_3$, clay, etc., and having at least one biaxially oriented base layer. Microvoids are said to be created by the biaxially stretching, where the bonds between the polymers and the solid fillers in the film are destroyed.

Although there is some similarity between the present invention and those of the references this invention is different from the art in at least the following areas:

1. In the formation of the preferred microporous film of the present invention, a homogenized polymer/mineral oil mixture is cast into a thin sheet and quenched to induce phase separation. The microporous structure is produced by extracting the mineral oil, with subsequent orientation. The resulting film is characterized by high porosity, low thermal conductivity, and better uniformity in pore size distribution. On the other hand, the substrate used by the prior art is manufactured by incorporating an inorganic filler, and the microstructure is produced by tearing the polymer matrix around the inorganic fillers. As a result, their substrate film is characterized by lower porosity, poorer thermal insulating properties, and less uniformity.

It has been found from scanning electron micrographs (SEM) examinations that the internal structure of the microporous film of the present invention is characterized by a multiplicity of spaced, randomly dispersed polymeric fibers, filaments, or fibrils with sizes mostly in the submicron range. These fine filaments throughout the film are separated from one another to form a network of interconnected micropores and the pores or cells are connected to each other by a plurality of these polymeric fibrils. On the other hand, the microstructure produced by tearing the polymer matrix around the inorganic particulate fillers is characterized by a multiplicity of parallel spaced, layered, long, and large polymeric fibers with sizes mostly over 2 micrometers. These relatively large filaments throughout the film are separated from one another by pigment particles to form long channels of air pockets. The air space is less than those occupied by the polymeric filaments.

2. The microporous film of the present invention does not need a pigment to induce opacity. Because of the absence of pigment particles, the film of the present invention is more capable of producing a uniform image. Also, for the same reason, the preferred microporous film of the present invention can be totally transparentized by exposing to heat.

The thermal dye transfer receptor sheets of this invention comprise at lease three layers: a flexible substrate sheet, a microporous thermal insulating film laminated to the supporting substrate, and a dye receiving layer either coated directly on or laminated on the surface of the microporous film.

Receptor Substrate

Substrates that are useful in practice of the present invention include flexible sheet materials such as paper, polymeric film, resin-coated paper, and the like. They can be transparent, translucent, or opaque, porous or nonporous. Most known polymers can be used as the substrate. However, they must possess the properties generally required for the dye receptors commonly used in the existing art. These properties include antistaticity, thermal stability, printer feedability, and adhesion to coatings. The methods for rendering these properties are known in the art. For transparency application, clear films of polyethylene terephthalate and polyvinyl chloride are preferred. For opaque receptor, pigmented films such as white polyester ($BaSO_4$-filled polyester), $CaCO_3$ or $TiO_2$-filled polyolefins, resin coated paper, and quality paper stock are preferred. The substrate normally requires a thickness of 50 to 250 micrometers depending on the thickness of the other components to be used in the total receptor construction.

Microporous Thermal Insulating Film Layer

The main purpose of the microporous insulating film layer is to minimize heat loss from the dye receiving layer to the receptor substrate, and to neutralize any adverse effects of the substrate on the image quality. Because the heat loss is through conduction, the microporous film must have uniformly low thermal conductivity or uniformly high insulating values (equivalent to reciprocal of thermal conductivity) to achieve the goal of increasing dye image densities and color uniformity.

The microporous films are made of thermoplastic resins. The thermal conductivity for these resins are relatively high, in the range of greater than 0.04 (up to 0.3 when measured at 165 degrees F.) and usually between 0.1–0.3 watts/m° C. compared to 0.03 watts/m° C. for air. A range of 0.04 to 0.1, or 0.05 to 0.1 watts/meter-degree C. is highly preferred. To get better insulation, the films must have high porosity to contain as much air as possible. Many known polymers, such as polyethylene, polypropylene, acrylic resins, polystyrene, poly(styrene-coacrylonitrile), poly(vinyl chloride), acetal resins, cellulose acetate, cellulose acetate butyrate, ethyl cellulose, can be used for making the microporous films. However, the polymers with lower thermal conductivity such as polypropylene and polystyrene are preferred. For transparency applications, low melting polymers such as polyethylene are preferred. The porosity of the films can be made very high. A typical microporous film made by the extrusion of polypropylene/mineral oil mixture is capable of producing as high as 94 vol % porosity (usually within the range of 60–94% by volume). The thermal conductivity of a microporous polypropylene film made for this invention with 82% porosity and 3.74% residual oil is measured at 0.045 watts/m° C. at 165° F. according to ASTM C-518 thermal conductance test method. The thermal conductivity of the microporous polypropylene film with 59% porosity is 0,068 watts/m° C. The microporous films used in this invention normally require a thermal conductivity of less than 0.1 watts/m° C. at 165° F., preferably less than 0.09 watts/m° C. and a porosity of more than 15% , preferably between 20 and 80% by volume. The thermal conductance test may be conveniently performed on a Dynatech C-Matic Heat Flowmeter, Thermal Conductive Tester.

The microporous insulating films used in the invention consist of a lot of pores, either open cell or closed cell types. The pores must be uniformly distributed throughout the sheet, and small in sizes, preferably smaller than 25 μm, and more preferably smaller than 5 μm. The films must have uniform thickness. Commercially available microporous membranes are usually very useful in this application because they possess the above-mentioned properties. The required thickness of the films is in the range of from 10 micrometers to 100 micrometers, preferably from 25 to 80 micrometers. The thickness requirements are dependent on the insulating properties of the film; the lower the thermal conductivity, the thinner the film is required. The films can be laminated to a suitable substrate sheet by the known methods such as pressure sensitive adhesive, resin solutions, etc.

The microporous films can be made from various polymers by various methods. Preferred polymers are the microporous crystallizable polymers shown in U.S. Pat. No. 4,726,989. These polymers include, but are not limited to polyolefins, nylons, polyvinylidene fluoride, polystyrene, polycaprolactam, etc. The microporous polymers made according to the practice of U.S. Pat. No. 4,726,989 are preferred because of their improved tensile strength, but microporous polymers may be made by other techniques and with other polymers such as those disclosed in U.S. Pat. No. 4,539,526 if one is willing to accept lower tensile strength in the polymer film.

The preferred microporous materials are made in accordance with the present invention by the following steps:

(a) melt blending to form a mixture comprising about 20 to about 80 parts by weight of crystallizable thermoplastic polymer, sufficient nucleating agent to initiate subsequent crystallization of the thermoplastic polymer at a significantly greater number of crystallization sites as compared to crystallization without the nucleating agent, and about 85 to about 20 parts by weight of a compound with which the thermoplastic polymer is miscible and in which the thermoplastic polymer will dissolve at the melting temperature of the thermoplastic polymer but which will phase separate on cooling to a temperature at or below the crystallization temperature of the thermoplastic polymer;

(b) forming a shaped article of the melt blended mixture;

(c) cooling the shaped article to a temperature at which the nucleating agent initiates the crystallization sites within the thermoplastic polymer so as to cause phase separation to occur between the compound and the polymer, thereby providing an article comprising an aggregate of a first phase comprising particles of crystallized thermoplastic polymer in a second phase comprising the compound with adjacent thermoplastic polymer particles being distinct but having a plurality of zones of continuity, wherein the particles have a size which is significantly reduced as compared to the size the particles would have if no nucleating agent were present; and (d) stretching the shaped article in at least one direction to separate adjacent particles of thermoplastic polymer from one another to provide a network of interconnected micropores there between and to permanently attenuate the thermoplastic polymer in the zones of continuity to form fibrils.

Preferably, the compound is removed from the article, e.g., by solvent extraction or by volatilization of the compound. However, the nucleating agent becomes incorporated within the interior of the particles of thermoplastic polymer, and is therefore typically not removed.

The formed article, before additive removal and stretching, is solid and generally transparent, and comprises an aggregate of a first phase of particles of crystallized thermoplastic polymer in a second phase of the additive compound, with nucleating agent in the interior of the particles of thermoplastic polymer. The particles may be described as spherulites and aggregates of spherulites of the polymer, with additive compound occupying the space between particles. Adjacent particles of polymer are distinct, but they have a plurality of zones of continuity. That is, the polymer particles are generally surrounded or coated by the compound, but not completely. There are areas of contact between adjacent polymer particles where there is a continuum of polymer from one particle to the next adjacent particle in such zones of continuity.

On stretching, the polymer particles are pulled apart, permanently attenuating the polymer in zones of continuity, thereby forming the fibrils, forming minute voids between coated particles, and creating a network of interconnected micropores. Such permanent attenuation also renders the article permanently translucent. Also on stretching, if the compound is not removed, the compound remains coated on or surrounds, at least partially, the surfaces of the resultant thermoplastic polymer particles. The degree of coating, of course, depends upon the affinity of the compound for the surface of the polymer particle, whether the compound is a liquid or solid, whether stretching dislodges or disrupts the coating, and upon other relevant factors. The particles are usually at least partially coated after stretching. Substantially all of the particles appear to be connected by fibrils. The size of the micropores is easily controlled by varying the degree of stretching, the amount and type of nucleating agent employed, the amount of additive compound employed, melt-quench conditions, compound removal, and heat stabilization procedures. For the most part, the fibrils do not appear to be broken by stretching, but they are permanently stretched beyond their elastic limit so that they do not elastically recover to their original position when the stretching force is released. As used herein, stretching means such stretching beyond the elastic limit so as to introduce permanent set or elongation of the article.

Certain terms are used in the specification and claims herein, that are well known for the most part, but may require some explanation.

Thus, it will be understood that, when referring to the thermoplastic polymer as being "crystallized," this means that it is at least partially crystalline. Crystalline structure in melt processed thermoplastic polymers is well understood by those skilled in the art. It will be further understood that the term "thermoplastic polymer" refers only to conventional polymers which are melt processable under ordinary melt processing conditions. The term "thermoplastic polymer" is not intended to include polymers characterized by including solely perfluoro monomeric units, e.g., perfluoroethylene units, such as polytetrafluoroethylene (PTFE) which, under extreme conditions may be thermoplastic and rendered melt processable temperature at which the polymer in a blend of polymer blending compound, and nucleating agent will melt. The term "crystallization temperature" refers to the temperature at which the polymer in the blend will approximately crystallize. The term "equilibrium melting point" refers to the commonly accepted melting temperature of the pure polymer, as may be available in published references.

The melting and crystallization temperature of a thermoplastic polymer, in the presence of a blending compound and a nucleating agent, is influenced by both an equilibrium and a dynamic effect. At equilibrium between liquid and crystalline polymer, thermodynamics require that the chemical potentials of the polymer repeating unit in the two phases be equal. The temperature at which this condition is satisfied is referred to as the melting temperature, which will depend upon the composition of the liquid phase. The presence of impurities (such as the blending compound) in the liquid phase will lower the chemical potential of the polymer repeating units in that phase. Therefore, a lower melting temperature is required to reestablish the condition of equilibrium, resulting in what is known as a melting temperature depression. Moreover, the nucleating agent serves to initiate a greater number of crystallization sites, thereby speeding up the crystallization process. The crystallization temperature and melting temperature are equivalent at equilibrium. However, at nonequilibrium conditions, which are normally the case, the crystallization temperature and melting temperature are dependent on the cooling rate and heating rate, respectively. Consequently, the terms "melting temperature" and "crystallization temperature," when used herein, are intended to include the equilibrium effect of the blending compound and nucleating agent as well as the dynamic effect of the rate of heating or cooling. Some examples of blends of crystallizable polymers and blending compounds which are useful in preparing microporous materials in accordance with the present invention include: polypropylene with mineral oil, dioctylphthalate, or mineral spirits; polyethylene with mineral oil or mineral spirits; polyethylene with mineral oil or mineral spirits; polypropylene-polyethylene copolymer with mineral oil; nylon (e.g., nylon 6–11) with triethylene glycol; and polyvinylidene fluoride with dibutyl phthalate. A particular combination of polymer and blending compound may include more than one polymer, i.e., a mixture of two or more polymers and/or more than one blending compound. Mineral oil and mineral spirits are examples of mixtures of blending compounds, since they are typically blends of hydrocarbon liquids. Similarly, blends of liquids and solids may also serve as the blending compound. Optionally, if desired, the polymer may include blended therein certain conventional additive materials, which materials should be limited in quantity so as not to interfere with the formation of the microporous material and so as not to result in unwanted exuding of the additive. Such additives may include, for example, antistatic materials, dyes, plasticizers, UV absorbers, and the like. When used, the amount of such conventional additive is typically less than about 10% of the weight of the polymer component, and preferably less than about 2% by weight.

The nucleating agent employed in the present invention serves the important functions of inducing crystallization of the polymer from the liquid state and enhancing the initiation of polymer crystallization sites so as to speed up the crystallization of the polymer. Thus, the nucleating agent employed must be a solid at the crystallization temperature of the polymer. Because the nucleating agent serves to increase the rate of crystallization of the polymer, the size of the resultant polymer particles or spherulites is reduced. Many unexpected and surprising benefits are achieved when using such a nucleating agent. First, it has been found that the usage of a nucleating agent allows for much greater quantities of additive compound to be used, relative to the amount of thermoplastic polymer used, in forming the microporous materials of the present invention. In this regard, it has been found that, by using a nucleating agent in accordance with the present invention, the compound to polymer ratio of the microporous materials can be increased by up to about 250% of the maximum compound to polymer ratio that the microporous materials would have if no nucleating agent were present. As a result, different microporous materials than heretofore possible may be created by using the present invention.

A second advantage of the microporous materials prepared by using a nucleating agent is that these oriented microporous materials have a surprisingly higher degree of porosity than would be achieved if no nucleating agent were employed, and the microporous materials prepared may be stretched to a surprisingly greater degree. In fact, the present invention makes it possible to prepare microporous materials which may be stretched to an area increase of over 1100%, which microporous materials could not even be prepared and stretched 10% without crumbling to the touch by techniques heretofore employed, such as those disclosed in U.S. Pat. No. 4,539,256. Thus, the present invention provides methods for preparing a broader range of useful microporous materials having a wider variety of porous and physical properties. As mentioned, when employing a nucleating agent in accordance with the present invention, the particles of thermoplastic polymer in the resultant microporous material are greatly reduced in size. For example, it 5 has presently been found that the size of the particles can be reduced by at least up to about 85% of the size said particles would have if no nucleating agent were present. For polypropylene, particle sizes of about 0.1 to about 5.0 microns have been achieved, with average particle sizes of 2 microns or less being typical. It will be understood, however, that the precise particle size obtained will be dependent upon the precise additive, component concentrations, and processing conditions employed. Moreover, the number of fibrils per unit volume and the length of the fibrils are dramatically increased by using a nucleating agent. In this regard, it has been found that the number of fibrils per unit volume may be increased by up to about 815% and that the length of the fibrils may be increased by up to about 700% than if no nucleating agent were used. One of the most surprising and beneficial results of the microporous materials made using a nucleating agent in accordance with the present invention is the excellent stretchability and tensile strength improvements of the microporous material. In this regard, it has presently been found that the stretchability of the resultant microporous material may be increased so that the total area of the material can be increased by up to about 1125%, and that the tensile strength may be increased by up to about 295% of the tensile strength that would be characteristic of the same microporous material made without a nucleating agent. Clearly, the dramatic increase in the stretchability of the microporous materials made possible by using a nucleating agent provides the way for the preparation of a multiplicity of microporous materials heretofore unknown.

Some examples of nucleating agents which have been found useful for purposes of the present invention include aryl alkanoic acid compounds, benzoic acid compounds, and certain dicarborylic acid compounds. In titanium dioxide ($TiO_2$), talc, adipic acid, benzoic particular, the following specific nucleating agents have been found useful: dibenzylidine sorbitol, titanium dioxide ($TiO_2$), talc, adipic acid, benzoic acid, and fine metal particles. It will be understood that the foregoing nucleating agents are given by way of example only, and that the foregoing list is not intended to be comprehensive. Other nucleating agents which may be used in connection with thermoplastic polymers are well known, and may also be used to prepare microporous materials in accordance with the present invention.

A melt blended mixture of the thermoplastic polymer, additive compound, and nucleating agent is first prepared. As used herein, the term "melt blended mixture" refers to the polymer, compound, and nucleating agent blend, wherein at least the polymer and compound are in the molten, semi-liquid, or liquid state. The nucleating agent in such a melt blended mixture may either be in the liquid state or in the solid state, depending upon the nucleating agent employed. All that is important is that, upon reaching the crystallization temperature of the thermoplastic polymer, the nucleating agent should, at that time, be in a solid state so as to be capable of inducing crystallization of the polymer. Hence, where the nucleating agent is a solid above the crystallization temperature of the polymer, the "melt blended mixture" is truly a mixture of liquid and solid, whereas if the nucleating agent is a liquid at some point above the crystallization temperature of the polymer, the "melt blended mixture" may in fact be a liquid solution of polymer, compound, and nucleating agent.

The melt blended mixture comprises from about 15 to about 80 parts by weight of the crystallizable thermoplastic polymer and about 85 to abut 20 parts by weight of the blending compound. The nucleating agent represents from about 0.1 to about 5 parts by weight of the polymer weight, with the presently preferred range being from about 0.2 to about 2 parts by weight. The melt blended mixture is prepared as follows. First, the nucleating agent and the thermoplastic polymer are dry blended as solids, preferably at room temperature. To this polymer/nucleating mixture is added the blending compound, and the combined mixture is heated to at least the melting temperature of the crystallizable polymer.

Dye Receiving Layer

The dye receiving layer of the present invention is either coated directly or laminated as an individual layer on the microporous insulating film. The receiving layer is referred to as a "dye receiving layer" even though in one practice of the present invention it is clearly contemplated that the receiving layer should be used in a thermal mass transfer process, alone, or in combination with a thermal dye transfer process. It consists mainly of a thermoplastic resin that has a strong affinity toward dyes and/or polymeric binders used in thermal mass transfer donors. The resinous binder layer, when contacted intimately with a dye donor under heat and pressure, receives the dye that diffuses or sublimes from the donor. Several classes of thermoplastic resins are known in the literature for use as a dye receiver. Desired properties often mentioned are molecular weight, glass transition temperature, compatibility, etc., all which contribute to the dye receptivity of the receptor. Suitable resins for use as dye receiving materials include polyester, polyurethane, polyacrylate, polyamide, polyvinyl chloride, polyvinyl acetate, sulfonated polyester or polyurethane, copolymers thereof, and copolymers of vinyl chloride, vinyl acetate and/or vinyl alcohol. Ethylene vinyl acetate copolymers, vinyl chloride-acrylate copolymers, and sulfonated epoxy hydroxy vinyl chloride copolymers are also particularly useful. Glass transition temperatures for these resins should be within the range of 30° C. to 150° C. Molecular weight of these materials is generally in the range of from 5,000 to 50,000.

Materials that have been found especially useful for forming the dye receiving layer include sulfonated hydroxy epoxy functional vinyl chloride copolymers such as MR-120 (a multifunctional vinyl chloride copolymer with hydroxy equivalent weight 1,890 g/mol, sulfonate equivalent weight 19,200 g/mol, epoxy equivalent weight 5,400 g/mol, Tg=65° C., Mw=30,000 obtained from Nippon Zeon Co., Tokyo, Japan), and MR-113 (also a multifunctional vinyl chloride copolymer with hydroxy equivalent weight 2,400 g/mol, sulfonate equivalent weight 11,000 g/mol, epoxy equivalent weight 2,100 g/mol, Tg=62° C., $M_w$=50,200 obtained from Nippon Zeon Co., Tokyo, Japan). They may be used alone or by blending with other polymers such those listed above. The limiting factors to the resin chosen for the blend vary only to the extent of compounding necessary to achieve the property desired. Preferred blendable additives include, but are not limited to polyvinyl chloride, copolymers of vinyl chloride, vinyl alcohol and/or vinyl acetate, polyesters (especially bisphenol A fumaric acid polyester), acrylate and methacrylate polymers, and anti-mass transfer releasing agents. When an addition polymer, copolymer, or releasing agent is used, it is usually added in an amount of 80 percent by weight or less of the resinous composition of the dye receiving layer, preferably in the amount of 10 to 75% by weight for non-release polymers, or 0.01 to 15% by weight for release polymers.

Release agents are generally characterized by low surface energy and include silicone and fluorinated polymers. The release agents are used to provide a receptor with anti-mass transfer properties, i.e., allowing only the transfer of dye from a dye donor in conventional thermal dye transfer imaging. However, it has been disclosed in our patent application Docket No. 48289USA8A, U.S. Serial No. 07/870,600 that a dual process involving both thermal dye transfer and thermal mass transfer imaging is very useful. The dual process is capable of making a dye transfer image from a dye donor ribbon and a mass transfer image from a thermal mass transfer donor onto a dual-functional thermal transfer image receiver. It has been found that certain thermoplastic resins such as the multifunctional vinyl chloride copolymers and some release agents can form such a dual-functional thermal transfer image receiver, having an image receiving layer coated on a substrate. These dual-functional thermal transfer receivers are characterized in that (a) no unwanted mass transfer (or blocking or sticking donor dye layer to the receptor) occurs during a thermal dye transfer imaging step, and (b) during a thermal mass imaging transfer step, the receiving layer is able to receive and adhere the mass transfer images.

Thermal dye transfer technology is known for its ability to provide an excellent continuous tone full-color image. On the other hand, thermal mass transfer, although lacking continuous tone imaging capability, is capable of generating a bright, dense, solid half-tone image. The image is typically yellow, magenta, cyan, or black, but other colors such as metallic or highly fluorescent colors may also be used to highlight the image. When these two technologies are used together, they can produce a blended image with excellent continuous tone full colors from the dye transfer imaging mode, highlighted with a bright metallic image from the mass transfer mode, such as a gold mark over the colored dye image.

One aspect of the present invention deals with the image receiving layer of the dual-functional receptor. The image receiving layer of the dual-functional receptor must have proper release property in order to receive conventional thermal transfer dye images without suffering from unwanted mass transfer during the dye transfer mode, and subsequently if so desired, receive a metallic or other mass transfer image in the mass transfer imaging mode. Preferably, the image receiving layer is also capable of adhering to other surfaces of interest under heat, or pressure or both during an optional post-imaged image layer retransfer step.

It has been found that the above mentioned multifunctional vinyl chloride copolymers, whose epoxy group reacts with an amino-modified silicone oil, form the desired dual-functional image receiving surface. Useful amino-modified silicone oils include, but are not limited to, those having an amino organic group attached to the polysiloxane side chain such as KF-393 available from Shin-Etsu Silicone of America, Inc., Torrance, Ca. the silicone content is kept as low as possible, normally below 3% but preferably less than 1% by weight of the image receiving layer. Other dyable polymers that require none or very little release additives and generally do not stick to the donor dye coat in thermal dye imaging are also useful for this application. This type of polymers includes, polyvinyl chloride, polyvinyl butyral, cellulose acetate butyrate, and cellulose acetate propionate.

In one embodiment, the dye receiving layer may be prepared by introducing the various components into suitable solvents, then coating the resulting mixture onto the microporous film. The viscosity of the coating solution, however, must be high enough to prevent the solution from filling the inner pores of the microporous film and destroying its insulating properties. Normally, the viscosity of the coating solution in this invention should be higher than 40 cps, preferably higher than 70 cps. The coating should be dried at moderate temperature to avoid melting the microporous film. The thickness of the dye receiving layer is from 1 micrometers to 100 micrometers, and preferably 3 micrometers to 10 micrometers.

In a preferred embodiment, the dye receiving layer may be coated onto a thin film support to form an integral dye receiving layer. The resulting integral dye receiving layer can be laminated permanently to the microporous film for the production of permanent color hardcopies. It can also be placed or laminated temporarily to the microporous film to form an intermediate dye receptor. After imaging, the integral dye receiver is removed from the microporous films. The imaged integral dye receiver can then be used by itself, or bonded to other support sheets of interest.

In another preferred embodiment, the film support of the integral dye receiver may be laminated to the microporous insulating film first, followed by coating the dye receiving layer. The thickness of the film support can be from 3 micrometers to 4 mils, (0.1 mm) depending on the intended uses. If the integral dye receiver is to be laminated permanently for the production of permanent hard copies, or to be removed and laminated to other substrates after imaging, the film should be as thin as practically possible, preferably thinner than 10 micrometers, and more preferably thinner than 7 micrometers to minimize heat loss to the film support. If the integral dye receiver is to be removed after imaging and used by itself without an additional support, the film thickness should be more than 15 micrometers, preferably from 20 micrometers to 3 mils (0.075 mm). The benefit from using the microporous insulator becomes insignificant if the thickness of the film support increases to 4 mils or more. Most known flexible polymeric sheets, either transparent or opaque, can be used as the film support of the integral dye receiver. However, they must possess good thermal stability, low thermal conductivity, and dimensional stability. For transparency and image retransfer applications, clear films of polyethylene terephthalate and polyvinyl chloride are preferred. The films can be pre-printed with a security code or pattern and the final image can be used as an I.D. cards, credit cards, etc.

Dye Transfer Imaging

The thermal dye transfer receptor layers of the invention are used in combination with a dye donor sheet wherein a dye image is transferred from the dye donor sheet to the receptor sheet by the application of heat. The dye donor layer is placed in contact with the dye receiving layer of the receptor sheet and selectively heated according to a pattern of information signals whereby the dyes are transferred from the donor sheet to the receptor sheet. A pattern is formed thereon in a shape and density according to the intensity of heat applied to the donor sheet. The heating source may be an electrical resistive element, a laser (preferably an infrared laser diode), an infrared flash, a heated pen, or the like. The quality of the resulting dye image can be improved by readily adjusting the size of the heat source that is used to supply the heat energy, the contact place of the dye donor sheet and the dye receptor sheet, and the heat energy. The applied heat energy is controlled to give light and dark gradation of the image and for the efficient diffusion of the dye from the donor sheet to ensure continuous gradation of the image as in a photograph. Thus, by using the dye receptor sheet of the present invention in combination with a dye donor sheet, thermal transfer systems can be used in the print preparation of a photograph by printing, facsimile, or magnetic recording systems wherein various printers of thermal printing systems are used, or print preparation for a television picture, or cathode ray tube picture by operation of a computer, or a graphic pattern or fixed image for suitable means such as a Video camera, and in the production of progressive patterns from an original by an electronic scanner that is used in photomechanical processes of printing.

Suitable thermal dye transfer donor sheets for use in the invention are well known in the thermal imaging art. Some examples are described in U.S. Pat. No. 4,853,365 which is hereby incorporated by reference.

Mass Transfer Imaging

The thermal dye transfer receptor sheets of the present invention can also be used in combination with a mass transfer donor sheet wherein a "mass" (i.e., colorant and resinous binder) image is transferred from the mass donor sheet to the receptor by the application of heat and pressure. In a manner similar to the thermal dye transfer imaging, the mass transfer donor layer is placed in contact with the receiving layer of the receptor sheet and imagewise heated to transfer the colorant and binder from the mass donor sheet to the receptor sheet. The receptor may be pre-imaged with dyes prior to the mass transfer imaging step. The dye image can be highlighted and overprinted with a vivid, bright mass transfer image, such as symbols, text, or picture. The heating source is the same as those used in the dye transfer mode, e.g., array of electrical resistive elements, lasers, or the like.

Suitable thermal mass transfer donor sheets for use in this invention include, but are not limited to, metallic donor ribbons and donor sheets composed of a colorant and a thermoplastic binder as disclosed in U.S. Pat. No. 4,847,237. The metallic donor ribbons may be made from aluminum vapor deposition to about 300 Angstroms on a 4.5 μm polyester film precoated with boehmite.

Process for Making Transparencies with High Image Density

One important aspect of the present invention deals with the methods for making transparencies with exceptionally high dye image densities. Generally, it is very difficult to make transparencies with high dye image densities because clear substrates for transparency receptors do not have good enough thermal insulating properties. This invention overcomes the difficulty by providing the transparency receptors with an opaque but transparentizable thermal insulating underlayer. Two useful methods, based on the use of this unique microporous insulator for making such transparencies are described below:

(1) Transparentizing the microporous film during and after imaging.

This method uses a special opaque receptor comprising the microporous film of this invention to receive high density images from a dye or mass or both transfer donor, followed by transparentizing the receptor sheet with heat. The process for preparing a color transparency comprises the steps of:

(a) providing a thermal dye transfer donor element having a substrate and a dye donor layer;

(b) providing a thermal mass transfer donor element consisting of a substrate and a mass donor layer;

(c) providing a thermal transfer receptor element comprising a clear film substage, a heat-transparentizable microporous insulating film under layer, and preferably a dual-functional image receiving layer containing a multifunctional vinyl chloride copolymer which has a Tg between about 50° and 85° C.; a weight average molecular weight between about 10,000 and 100,000 g/mol; a hydroxyl equivalent weight between 500 and 7,000 g/equiv.; and an epoxy equivalent weight between about 500 to 7,000 g/equiv.; an optional sulfonate equivalent weight between about 9,000 and 23,000 g/equiv, wherein a reactive amino-modified silicone is chemically bonded to said vinyl chloride copolymer;

(d) transferring a dye image from said thermal dye donor to said receptor;

(e) optionally, transferring a mass image from said thermal mass transfer donor to said receptor; and (f) transparentizing the microporous film by exposing it to heat.

(2) Separating the opaque microporous film after imaging

This method uses a special intermediate opaque receptor comprising the microporous film of this invention as an intermediate carrier to receive high density images from a dye or mass or both transfer donor, followed by removing the opaque base. The process for preparing a color transparency comprises the steps of:

(a) providing a thermal dye transfer donor element having a substrate and a dye donor layer;

(b) providing a thermal mass transfer donor element consisting of a substrate and a mass donor layer;

(c) providing a thermal transfer receptor element comprising a substrate, a microporous insulating film underlayer, and an integral image receiver that consists of a thin clear film and a dual-functional image receiving layer containing a multifunctional vinyl chloride copolymer which has a Tg between about 50° and 85° C.; a weight average molecular weight between about 10,000 and 100,000 g/mol; a hydroxyl equivalent weight between 500 and 7,000 g/equiv.; and an epoxy equivalent weight between about 500 and 7,000 g/equiv.; an optional sulfonate equivalent weight between about 9,000 and 23,000 g/equiv, wherein a reactive amino modified silicone is chemically bonded to said vinyl chloride copolymer;

(d) transferring a dye image from said thermal dye donor to said receptor;

(e) optionally, transferring a mass image from said thermal mass transfer donor to said receptor;

(f) removing the opaque microporous film base from the integral image receiver; and (g) optionally, laminating said integral image receiver to a transparent film support.

EXAMPLES

Example 1. Preparation of Microporous Film—

Crystallizable polypropylene (available under the trade name, "Profax" type 6723 from Himont Inc.) having a density of 0.903 g/cc, a melt flow index (ASTM D1238, Condition I) of 0.8 and a melting point of about 176° C. was introduced at a rate of 17 lbs/hr into the hopper of a Berstorff 40 mm twin screw extruder fitted with a 30.5 cm by 0.04 mm slit gap sheeting die position above a casting wheel. A precompounded concentrate of the same polymer containing 2 wt % nucleating agent (available from Milliken Chemical under the trade designation Millad 3905) was introduced at a rate of 3 lb/hr into the hopper. Simultaneously, mineral oil (from Amoco Oil Co.), having a boiling point of about 200° C. and a standard Saybolt viscosity of 360–390 at 38° C. was introduced into the twin screw extruder through an injection port at a rate of 30 lb/hr At 177° C. the mixture was cast onto a casting wheel which was maintained at about 65.6° C., producing a quenched film at the rate of 10 ft/min. Using 1,1,1-trichloroethane the cast film was extracted to remove mineral oil. The resulting opaque porous film was oriented 200% in the machine direction at 100° C. and 225% in the transverse direction at about 110° C., and heat set at 148.9° C.

The porosity, bubble point pore size, and air flow resistance of the resulting film were measured according to ASTM D-792-66, ASTM F-316-80, and ASTM D-726-58, Method A (by using a Gurley densimeter to measure the time in seconds to pass 50 cc of air through the film), respectively. A microporous polypropylene film made per U. S. Pat. No. 4,726,989 having a bubble point pore size of 0.35 micron, a void volume of 73.3%, a thickness of 7 mils and residual oil of 12.7 wt % was used in the following Example 2.

Example 2. Receptor Construction—The receptor consists of a microporous film base prepared in Example 1, and a dye receiving layer. The microporous polypropylene film as described in Example 1 with a thickness of 7 mils containing 6% of residual oil was used as a receptor substrate, and was coated with a dye-receiving solution containing 2.98 wt % of MR-120 (a vinyl chloride copolymer with hydroxyl equivalent weight 1890 g/mol, sulfonate 19,200 g/mol, epoxy 2,400 g/mol, Tg=65° C., Mw about 30,000 obtained from Nippon Zeon Co., Tokyo, Japan), 11.90 wt % of Ucar$^R$ VYNS-3 (a vinyl chloride/vinyl acetate copolymer, 9:1 by weight, Mn=44,000, Union Carbide, Danbury, Ct.), 0.40 wt % of KF-393 (an amino-modified silicone fluid from Shin-Etsu Chemical C0., Ltd., Tokyo, Japan) and 84.72 wt % of MEK using a #12 Meyer bar. The coating when dried in an oven at 100° C. for 1 minute resulted in a dry coating weight of 6 micrometers.

The receptor, two days after coating, was tested on a 3M Rainbow™ Desktop Color Proofer (3M Co., St. Paul, Mn.) using a standard self print pattern and 3M Desktop Color Proofing Ribbon (3M Co., St. Paul, Mn.) color ribbon. It produced a vivid, dense, uniform full color image. The resulting color image density was measured with a Gretag SPM-100 Spectrophotometer and compared to those from using different substrates under the same testing conditions (see Table 1). The thermal conductivity of each of the receptor substrates was measured using ASTM C-518, Dynatech c-Matic Heat Flowmeter, Thermal Conductive Tester, Model TCHM-DV at 165° F.

TABLE 1

| Effect of Substrate on Dye Receptivity (Receptors were coated the same dye receiver) | | | | | | |
|---|---|---|---|---|---|---|
| | Image Color Density, ROD | | | | Image | Thermal Conductivity |
| Receptor Base | Yellow | Magenta | Cyan | Black | Uniformity | (watts/m °C.) |
| A. synthetic papers from Kimberly-Clark (Atlanta, GA): | | | | | | |
| Kimdura 200 | 0.74 | 1.09 | 1.32 | 1.14 | Frosty | NA |
| Kimdura 4405 | 0.87 | 1.60 | 1.79 | 1.36 | Slt. Frosty | NA |
| Kimdura GFG130 | 0.86 | 1.39 | 1.61 | 1.28 | Good | 0.07 |
| B. Unstretched Polypropylene rifled with $CaCO_3$: | | | | | | |
| "Gem" film (3M) | 0.63 | 0.74 | 0.89 | 0.84 | Good | 0.24 |
| C. Micropomus polypropylene with 73.3% porosity: | | | | | | |
| This invention | 0.96 | 1.70 | 2.18 | 1.67 | Excellent | 0.055 |

It is seen from the above-table that the microporous polypropylene with low thermal conductivity when used as a receptor substrate outperformed the $CaCO_3$-filled unstretched polypropylene and the synthetic papers from Kimberly-Clark in terms of image color density and uniformity.

Example 3. Image Receptivity -vs- Receptor Substrate Insulation Value: A 6 micrometers Teijin PET film (Teijin, Tokyo, Japan) was coated with the same dye receiving layer as Example 2. It was then placed atop three microporous polypropylene films, prepared using the same procedures as described in Example 1, which were attached to a 5 mil polyester film support, with the dye receiver facing up. The composite was then used as a dye receptor and was tested on the same printer using the same donor ribbon and test pattern. In an identical manner, several different substrates with different thermal conductivity were used as a support to the thin dye receiving ribbon and were tested in the same way. The results are presented in the Table 2, along with thermal conductivity data.

The thermal conductivity of each of the receptor substrates was measured using ASTM C-518, Dynatech-Matic Heat Flowmeter, Thermal Conductive Tester, Model TCHM-DV at 217° F.

TABLE 2

| Effect of Substrate Thermal Conductivity on Dye Receptivity | | |
|---|---|---|
| Receptor Base | Substrate Thermal Conductivity, watts/m °C. | Cyan Image Density, ROD |
| A. Synthetic papers from Kimberly-Clark (Atlanta, GA): | | |
| Kimdura GFG130 | 0.073 | 1.75 |
| B. Microporous polypropylene films (this invention): | | |
| (1) 82% porosity, 3.74% residual oil | 0.042 | 2.45 |
| (2) 80% porosity, 6.4% residual oil | 0.048 | 2.16 |
| (3) 59 % porosity, 27.7% residual oil | 0.074 | 1.89 |
| C. Dye receptor using synthetic paper as substrate (Dai Nippon Printing, Tokyo, Japan): | | |
| DNP T-1 | 0.127 | 1.69 |

TABLE 2-continued

| Effect of Substrate Thermal Conductivity on Dye Receptivity | | |
|---|---|---|
| Receptor Base | Substrate Thermal Conductivity, watts/m °C. | Cyan Image Density, ROD |
| D. White polyester filled with $BaSO_4$ (ICI Americas Inc., Wilmington, DE): | | |
| Melinex ® Type 329 | 0.126 | 1.30 |

It is seen from Table 2 that the dye receptivity of a receptor is strongly affected by the thermal insulation value (reciprocal of thermal conductivity) of the receptor base. The dye image density increased with increasing thermal insulation values (or decreasing thermal conductivity). The ICI white polyester with a thermal conductivity of 0.126 watts/m° C. produced an image density of 1.30. The microporous polypropylene films of this invention with very low thermal conductivity, ranging from 0.042 to 0.074, gave the highest image density, outperforming the other types of bases tested under the same condition.

Example 4. Making Transparency with High Color Image Density Using Microporous Polyolefin Insulating Film:

Receptor A without microporous insulator—A Scotchpar® 4-mil polyester film (3M Co., St. Paul, Mn.) was coated with a dye receiving solution containing 2.98 wt % MR-120 (a vinyl chloride copolymer with hydroxyl equivalent weight 1890 g/mol, sulfonate 19,200 g/mol, epoxy 2,400 g/mol, Tg=65° C., Mw about 30,000 obtained from Nippon Zeon Co., Tokyo, Japan), 11.95 wt % VYNS-3 (a vinyl chloride/vinyl acetate copolymer, 9:1 by weight, Mn=44,000, Union Carbide, Danbury, Ct.), 0.45 wt % of KF-393 (an amino-modified silicone fluid from Shin-Etsu Chemical CO., Ltd., Tokyo, Japan), and 84.62% MEK with a Meyer bar to give a dry coating weight of about 6 g/m$^2$. The film after drying was tested on the 3M Rainbow™ Desktop Color Proofer (3M Co., St. Paul, Mn.) using a standard self print pattern and 3M Desktop Color Proofing Ribbon (3M Co., St. Paul, Mn.). It produced a full color image with a reflectance optical density (ROD measured with a Gregtag SPM-100 densitometer) of 0.79 for yellow, 1.20 for magenta, 1.20 for cyan and 1.00 for black.

Receptor B with a microporous insulator layer—The same 3M Scotchpar® 4-mil polyester film laminated with 0.8 mil HDPE (high density polyethylene) microporous film was used as a receptor substrate. The composite became opaque because of the presence of the microporous polyethylene film. On the microporous film surface the same dye receiving solution as used in the above Receptor A was coated to a dry coating weight of 6 g/m$^2$ and the resulting receptor was tested on the same printer under the same conditions. It produced a full color image with a higher color image density on this receptor than those on the above receptor without an insulating underlayer. The results are summarized in Table 3.

TABLE 3

Comparison of Dye Receptivity of Receptors A & B

| | Image Density, ROD | | | |
|---|---|---|---|---|
| Receptor ID | Yellow | Magenta | Cyan | Black |
| A w/o insulator | 0.79 | 1.20 | 1.20 | 1.00 |
| B w/insulator | 1.06 | 1.69 | 1.84 | 1.46 |

It is seen from the above table that Receptor B with a microporous polyethylene insulator gained at least 34% more image density over Receptor A. It was noted that some of the imaged area in Receptor B became transparentized during imaging. The sample was further transparentized by exposing the sample in an oven to 100° C. for 4 minutes, resulting a transparency with high image density.

Example 5. Dual-functional dye and mass transfer image receptor

A 200-ft roll of transparent dual functional thermal transfer image receptor was prepared by slot-coating a solution containing 4.8 wt % MR-120, 4.8 wt % VANS-3, and 0.38 wt % DF-393 in methyl ethyl ketone on a latex primed polyester film (4 mil thick, 3M) at 50 feet per minute and drying through a 50 foot oven at 65.6 to 93.9° C. The dry coating weight was 5 g/m$^2$.

The receptor was stored at room temperature for a week. It was then tested on the 3M Rainbow™ thermal transfer printer for dye receptivity and anti-mass transfer property during the dye transfer imaging step. A four color (yellow, magenta, cyan, and black) ribbon (PE-433 3M Desktop Color Proofing Ribbon, 3M Co., St. Paul, Mn.) was used to test the receptor using the printer's built-in self test pattern. A clean and sharp full color continuous-tone image was produced and there was not mass transfer problem in the dye transfer imaging process. The image was very dense, showing color maximum density (ROD) of 0.89, 1.37, 1.41, and 1.19 for yellow, magenta, cyan, and single black, respectively.

The receptor was further tested for its dual-functionality through the same printer using a mass transfer imaging mode. Using a metallic mass transfer donor ribbon, the receptor with the continuous tone dye image was highlighted with a solid metallic mass transfer image. The metallic ribbon used here was made from aluminum vapor deposition to about 300 Angstrom on a 4.5 μm polyester film precoated with boehmite. This resulted in a blended image showing a bright, solid silver picture of "Reindeer" partially overprinted on the dye-imaged receptor.

Example 6. Making High Image Density Transparencies

Two integral dye receivers were prepared by coating a 6 micrometers Teijin PET film (Teijin, Tokyo, Japan) and a 3 mils Scotchpar® PET film (3M Co., St. Paul, Mn.) with the same dye receiving layer as Example 2. Two carry film bases were prepared by laminating a 3.7-mil microporous polypropylene film (80% porosity, 6.4% residual oil, 0,048 watts/m-degree C. thermal conductivity, prepared according to Example 1) to a 4-mil polyester film.

The two integral dye receivers were individually fastened to the microporous film-covered carry bases with the dye receiving layer facing up. Using an electronic 7-color rendition pattern, the composites were individually tested for dye receptivity on the same thermal transfer printer and the same transfer donor ribbon as in Example 2. The resultant images on both receptors were very uniform and exceptionally dense. The maximum reflectance optical densities on the thinner dye receptor were 2.50, 2.04, and 1.10 for cyan, magenta and yellow, respectively. The image densities on the thicker receptor were 2.12, 1.80 and 1.05 respectively for cyan, magenta, and yellow. Although the image densities on the thicker receptor were lower than those on the thinner one, they were still 20% denser than the receptors without using a microporous insulating carrier.

After dye imaging, the opaque receptor carry bases were separated from the transparent integral dye receivers. The 2-mil integral receiver was used alone without needing additional support. The 6-micrometer integral receptor was laminated with imaged side down to a 4-mil clear polyester film precoated with a polyester resin (Vitel® PE-200D from Goodyear Tire & Rubber Co., Akron, Oh.) by 3M Matchprint laminator at 290° F. The transparency thus produced had the 6-micrometer polyester film protecting the underlying image.

We claim:

1. A thermal dye transfer system comprising a thermal dye transfer receptor element in intimate contact with a thermal dye donor sheet, said receptor element comprising a substrate having on at least one surface thereof in contact with said dye transfer donor sheet, a dye receptive receiving layer, and a microporous polymer underlayer having 59 to 94 volume percent porosity with pores which are smaller than 25 μm, and having insufficient pigment to provide an optical density of more than 0.2.

2. The thermal dye transfer system of claim 1 wherein at least 60% of pores in said microporous polymer contain gas.

3. The thermal dye transfer system of claim 2 wherein the dye receptive receiving layer is in contact with both a thermal dye transfer donor element and a thermal mass transfer donor element.

4. The thermal dye transfer system of claim 2 wherein said microporous polymer layer comprises a crystallizable polymer.

5. The thermal dye transfer system of claim 4 wherein said microporous polymer layer comprises a mixture of said crystallizable polymer and another polymer, said crystallizable polymer comprising at least 25% by weight of polymeric material in said microporous Dolvmer layer.

6. The thermal dye transfer system of claim 5 wherein said thermal dye donor sheet comprises a substrate having on only one surface thereof a layer comprising a thermally transferable dye.

7. The sheet material of claim 2 wherein said microporous polymeric layer has a thermal conductivity of 0.04 to 0.3 watts per meter-degree Centigrade at 165 degrees Fahrenheit.

8. The thermal dye transfer system of claim 1 wherein the dye receptive receiving layer further comprises an ultraviolet radiation absorber.

9. The thermal dye transfer system of claim 1 wherein said microporous polymer layer comprises a polymer selected from the group consisting of polyolefins, polystyrene, polyamides, cellulose acetate, cellulose nitrate and polyvinylidene fluoride.

10. The thermal dye transfer system of claim 1 wherein said thermal dye donor sheet comprises a substrate having on only one surface thereof a layer comprising a thermally transferable dye.

11. A process of transferring an image using the thermal dye transfer system of claim 1 wherein heat is applied in an imagewise distribution to the side of said thermal dye donor sheet farthest from said dye receiving layer, said heat being applied in an amount sufficient to thermally transfer dye.

12. The sheet material of claim 1 wherein said microporous polymer contains no pigment.

13. The sheet material of claim 1 wherein said microporous polymer layer has a thermal conductivity of 0.04 to 0.3 watts per meter-degree Centigrade at 165 degrees Fahrenheit.

14. The thermal dye transfer system of claim 1 in which the pores in the microporous polymer layer are uniformly distributed.

15. A thermal dye transfer system comprising a thermal dye transfer receptor element in intimate contact with a thermal dye donor sheet, said receptor element comprising a substrate having, on at least one surface thereof in contact with said dye transfer donor sheet a dye receptive receiving layer, and an underlayer comprising a microporous crystallizable polymer having a glass transition temperature between −55° and 70° C.

16. The thermal dye transfer system of claim 15 wherein a thermal mass transfer donor layer is in contact with said dye receptive receiving layer.

17. An image bearing sheet comprising a substrate having, on at least one surface thereof, a dye receptive receiving layer, and an underlayer comprising a microporous crystallizable polymer, and on said dye receptive layer at least one dye distributed in an imagewise manner.

18. The sheet of claim 17 wherein, in addition to said dye distributed in an imagewise manner on said dye receiving layer, there is also an imagewise distribution of pigment in a binder on said dye receptive receiving layer.

19. The sheet of claim 18 wherein said image consists of dye and pigment in binder.

20. The sheet of claim 17 wherein said image comprises at least three different color dyes on said dye receptive layer.

21. The sheet of claim 20 wherein said image consists of dye.

22. The sheet of claim 17 wherein said image consists of dye.

23. The sheet material of claim 22 wherein said microporous polymer contains no pigment.

24. The sheet material of claim 22 wherein said microporous polymeric layer has a thermal conductivity of 0.04 to 0.3 watts per meter-degree Centigrade at 165 degrees Fahrenheit.

25. A thermal imaging process comprising the steps of (a) providing 1) a thermal dye transfer donor element having a substrate and a dye donor layer or 2) a thermal mass transfer donor element consisting of a substrate and a mass donor layer;

(b) providing a thermal transfer receptor element comprising a substrate, a microporous insulating film underlayer, and an integral image receiver layer (c) transferring a dye image from said thermal dye donor to said receptor or transferring a mass image from said thermal mass transfer donor to said receptor; and (d) removing the opaque microporous film base from the integral image receiver.

26. The process of claim 25 wherein said integral image receiver layer comprises a thin clear film and a dual-functional image receiving layer containing a multifunctional vinyl chloride copolymer which has a Tg between about 50° and 85° C.; a weight average molecular weight between about 10,000 and 100,000 g/mol; a hydroxyl equivalent weight between 500 and 7,000 g/equiv.; and an epoxy equivalent weight between about 500 and 7,000 g/equiv.; an optional sulfonate equivalent weight between about 9,000 and 23,000 g/equiv, wherein a reactive amino modified silicone is chemically bonded to said vinyl chloride copolymer;

27. The process of claim 25 wherein after removing the opaque microporous film, said integral image receiver is laminated to a transparent film support.

28. A thermal dye transfer system comprising a thermal dye transfer receptor element in intimate contact with a thermal dye donor sheet, said receptor element comprising a substrate having on at least one surface thereof in contact with said dye transfer donor sheet a dye receptive receiving layer, and an underlayer comprising an opaque, thermally transparentizable microporous polymer layer having insufficient pigment to provide an optical density of more than 0.2.

29. The process for preparing transparency comprising:

(a) providing 1) a thermal dye transfer donor element having a substrate and a dye donor layer or 2) a thermal mass transfer donor element having a substrate and a mass donor layer;

(b) providing a thermal transfer receptor element comprising a substrate, a microporous insulating film underlayer, and an integral image receiver layer;

(c) transferring a dye image from said thermal dye donor to said receptor or transferring a mass image from said mass transfer donor to said receptor; and (d) transparentizing the microporous film by exposing it to heat.

* * * * *

UNITED STATES PATENT AND TRADEMARK OFFICE

CERTIFICATE OF CORRECTION

PATENT NO.: 5,455,217

DATED: Oct. 3, 1995

INVENTOR(S): Jeffrey C. Chang, Andrew B. Becker, and Gari P. Krogseng

It is certified that error appears in the above-identified patent and that said Letters Patent is hereby corrected as shown below:

Column 4, line 2, delete "Systems." and insert --systems.--

Column 8, line 29, delete "stretching" and insert -- "stretching" --.

Column 10, lines 46-47, delete "In titanium dioxide ($TiO_2$), talc, adipic acid, benzoic particular," and insert --In particular,--.

Column 16, line 21, delete "lb/hr At" and insert --lb/hr. At--.

Column 17, line 23, delete "above-table" and insert --above table--.

Column 17, line 44, delete "Dynatech-Matic" and insert --Dynatech c-Matic--.

Column 20, line 59, delete "Dolvmer" and insert --polymer--.

Signed and Sealed this

Twenty-third Day of January, 1996

*Attest:*

Bruce Lehman

BRUCE LEHMAN

*Attesting Officer*

*Commissioner of Patents and Trademarks*